United States Patent [19]

Dunn

[11] Patent Number: 4,476,847

[45] Date of Patent: Oct. 16, 1984

[54] ADJUSTABLE DOUBLE DISC GRINDER DRESSER

[75] Inventor: Elman R. Dunn, Roscoe, Ill.

[73] Assignee: Litton Industrial Products, Inc., South Beloit, Ill.

[21] Appl. No.: 414,455

[22] Filed: Sep. 2, 1982

Related U.S. Application Data

[63] Continuation-in-part of Ser. No. 322,987, Nov. 19, 1981, Pat. No. 4,462,187.

[51] Int. Cl.[3] ..... B24B 53/00

[52] U.S. Cl. ..... 125/11 DF; 51/111 R

[58] Field of Search ..... 125/11 DF, 11 A; 51/111, 117, 118, 5 D; 308/189 R, 190, 191

[56] References Cited

U.S. PATENT DOCUMENTS

| | | | |
|---|---|---|---|
| 2,082,736 | 6/1937 | Indge | 51/118 |
| 3,827,420 | 8/1974 | Hoglund | 125/11 A X |
| 3,846,940 | 11/1974 | Dunn | 51/118 |

*Primary Examiner*—Frederick R. Schmidt
*Assistant Examiner*—Debra S. Meislin
*Attorney, Agent, or Firm*—Spencer T. Smith

[57] ABSTRACT

An adjustable double disc grinder dresser comprising a dresser arm mounted on a shaft, a bracket including spaced opposing walls, one of the walls supporting one end of the shaft for pivotal displacement about its axis and for limited pivotal displacement about mutually perpendicular vertical and horizontal axes, the support including a face to face mounted pair of ball bearings, and a spacer having a width selected to locate the bearing load centers of the ball bearings coincident on the axis of rotation of the shaft, the mutually vertical and horizontal axes intersecting at the point of coincidence, and adjustment screws for infinitely varying the horizontal location of the axis of the shaft through a limited range, and a support for the other end of the shaft permitting pivotal displacement about its axis and for limited pivotal displacement about mutually perpendicular vertical and horizontal axes, the other support including a face to face mounted pair of ball bearings, and a spacer having a width selected to locate the bearing load centers of the ball bearings coincident on the axis of rotation of the shaft, the mutually vertical and horizontal axes intersecting at the point of coincidence, and structure for infinitely varying the vertical location of the axis of the shaft through a limited range, whereby the ends of the shaft can be shifted relatively horizontally and vertically to align the shaft axis.

2 Claims, 5 Drawing Figures

ADJUSTABLE DOUBLE DISC GRINDER DRESSER

This application is a continuation-in-part of copending patent application Ser. No. 322,987 filed on Nov. 19, 1981 now U.S. Pat. No. 4,462,187, issued July 31, 1984.

BACKGROUND OF THE INVENTION

Double disc grinding machines use two abrasive disc wheels to remove stock and meet tolerance requirements on two opposite and parallel sides of product components or workpieces.

In double disc grinding machines, the angular relationship of the abrasive disc wheels is changeable as required to produce optimum grinding performance. The procedure is referred to as headsetting. Headsetting is accomplished at the time of the first assembly of the grinding machine and throughout its service life as required to maintain the spindle axes of the opposing discs in true alignment with each other.

The grinding discs are normally dressed by a cutter arm which traverses the face of the discs by rotating through an arc about is own axis.

Both the axes of the spindles and the axis of the dresser arm are referenced to the frame of the grinder. If, after headsetting, the axes of the spindles and the axis of the dresser are not in the same relationship to the frame of the machine and in a parallel relationship to each other, a means must be provided to realign the dresser axis.

SUMMARY AND OBJECTS OF THE INVENTION

An adjustable double disc grinder dresser is a rotatable arm on which is mounted a star or diamond cutting head and whose pivot axis can be repositioned in two orthogonal planes to provide for parallel alignment of the axis with the common axis of the spindles of the grinder.

It is therefore an object of the invention to provide an adjustable double disc grinder dresser.

It is a further object of the invention to provide a dresser which, through a rotatable arm, traverses the faces of the abrasive discs with a suitable cutting head.

It is also an object of the invention to provide a dresser wherein the axis of rotation of the arm is readily adjusted to provide parallel alignment with the spindle axis.

It is a further object of the invention to provide a dresser wherein the adjusting feature of its axis of rotation in no way compromises the inherent stiffness of the mechanism essential to the precision of the dressing operation.

Other objects and advantages of the present invention will become apparent from the following portion of the specification and from the accompanying drawings which illustrate, in accordance with the mandate of the patent statutes, a presently preferred embodiment incorporating the principles of the invention.

DESCRIPTION OF THE PREFERRED EMBODIMENT

Figure 1:
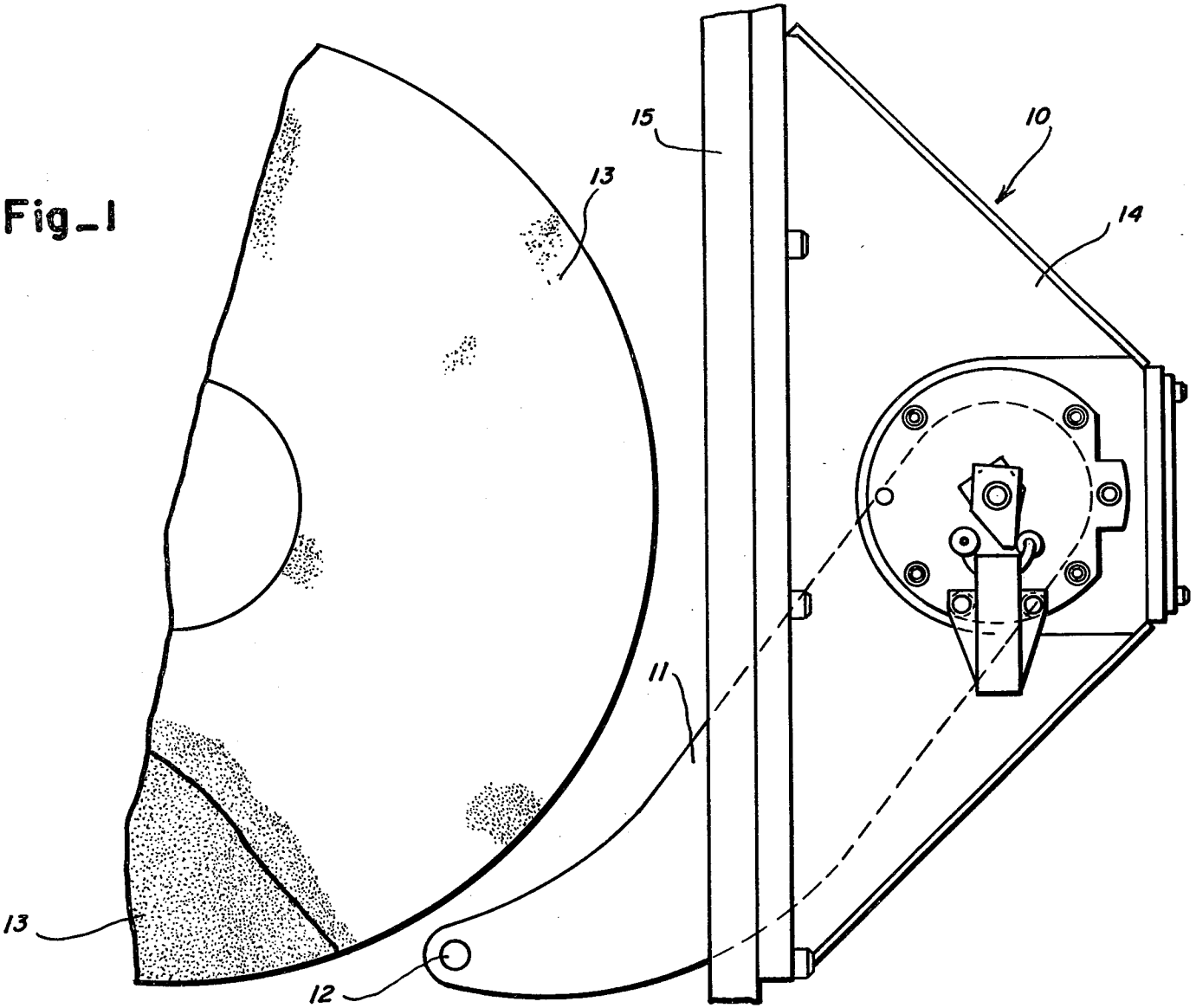
FIG. 1 is a plan view of the dresser assembly and abrasive discs.
Figure 2:
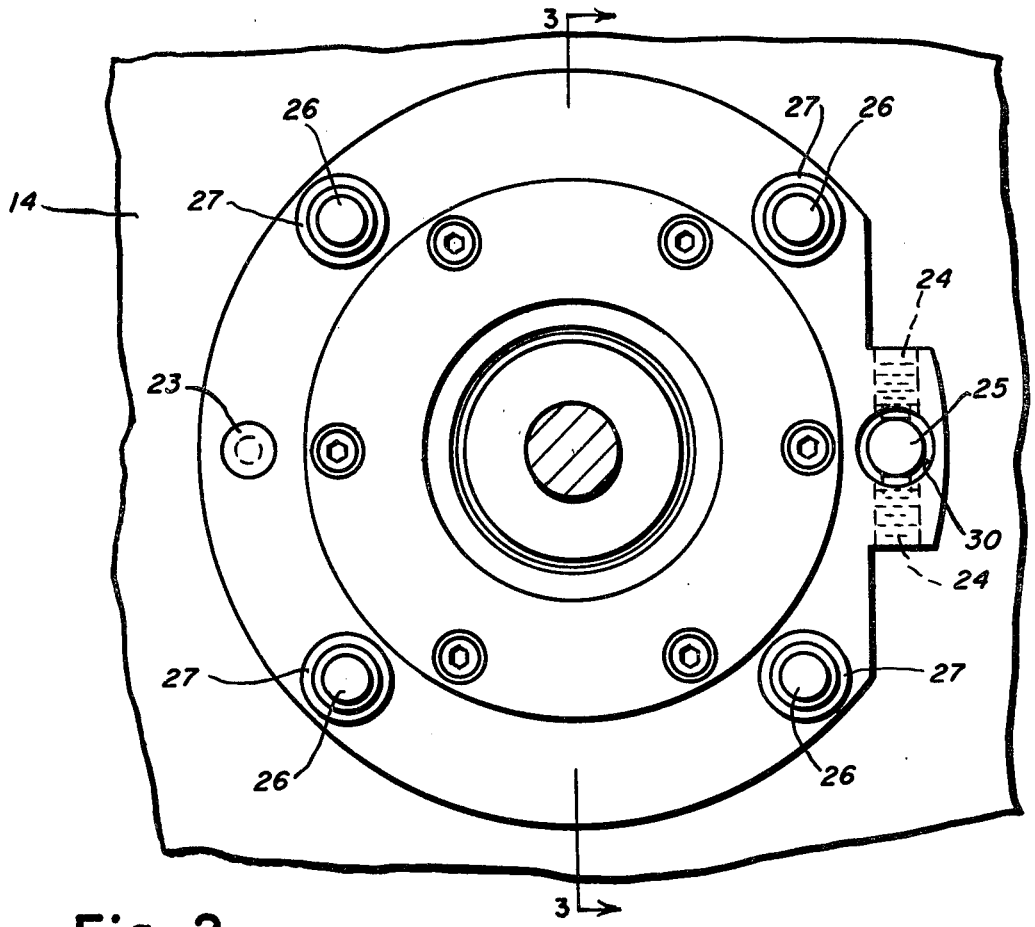
FIGS. 2 and 4 are opposite end views of the supports of an adjustable double disc grinder dresser made in accordance with the teachings of the present invention.

FIG. 1 represents the adjustable double disc grinder dresser assembly 10 mounted to the frame 15 of a double disc grinder through the dresser bracket 14 and illustrates the relationship of the dresser arm 11 with its cutting head 12 to the abrasive discs 13.

Figure 3:
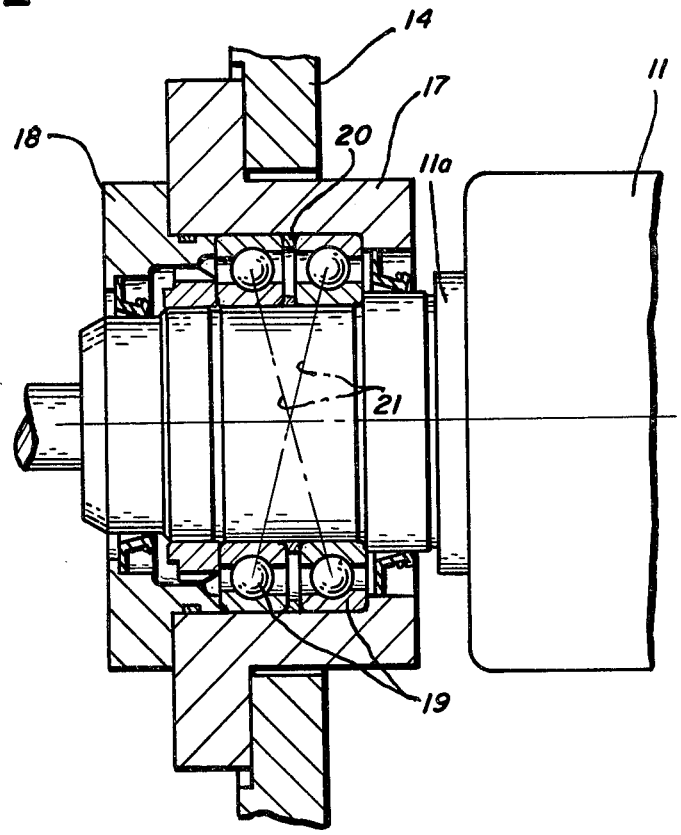
FIG. 3 is a sectional view taken along line 3—3 of FIG. 2.
Figure 4:
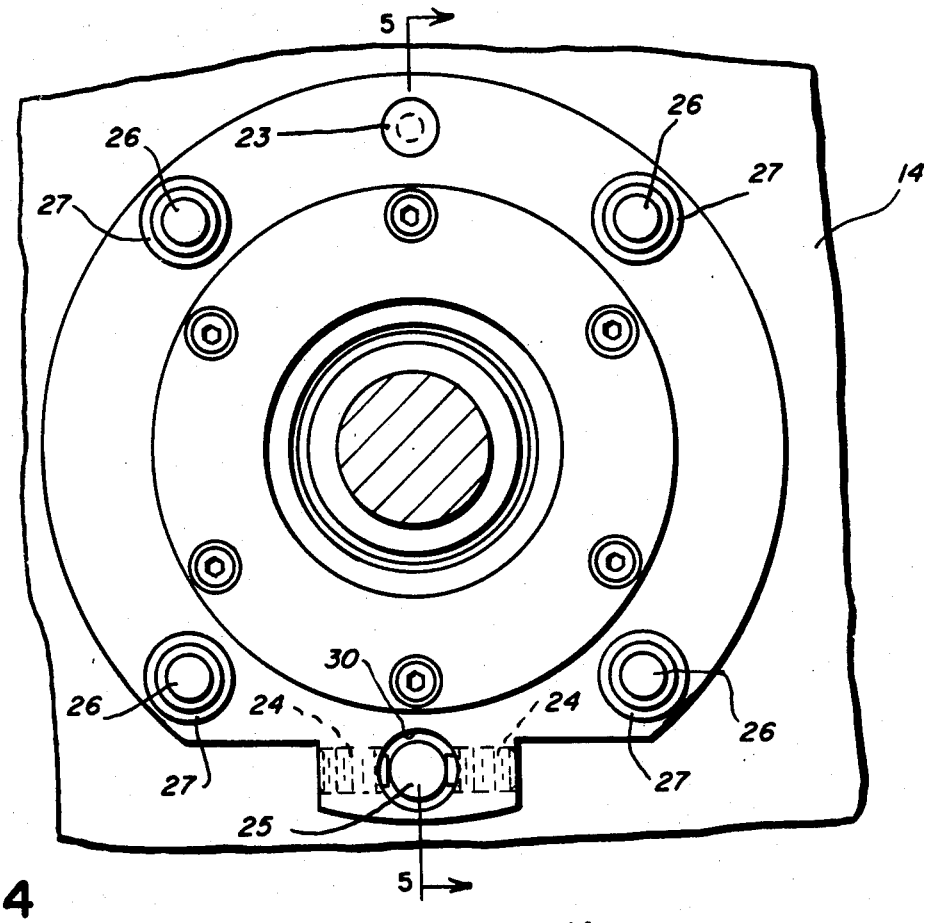
Figure 5:
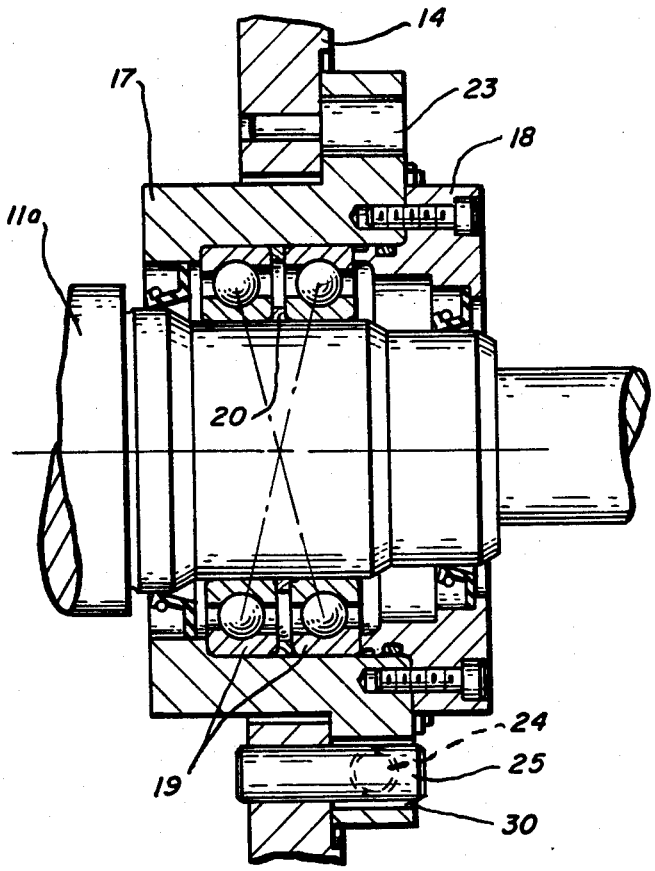
FIG. 5 is a sectional view taken along line 5—5 of FIG. 4.

Referring to FIGS. 2 through 5, the dresser arm 11, including the spindle 11*a* to which it is secured, is mounted to the dresser bracket 14 through the ball bearings 19 and the bearing housing 17. The shaft is supported at each end for pivotal displacement about its axis and for limited pivotal displacement about mutually perpendicular vertical and horizontal axes. The bearings are held in a preloaded condition in the housing 17 by means of the bearing housing cap 18 and are separated from each other by the spacer element 20 which permits both of the bearing housings to be slightly offset radially, each to the other, with no deleterious effect on the bearings 19. The width of the spacer element 20 is selected so as to align the load paths 21 of opposing bearings 19 as indicated in FIG. 3, thus minimizing the effect of a slight offset on the bearings 19.

The radial offset is accomplished by loosening the locking screws 26 which, acting through the Belleville spring washers 27, secure the bearing housing 17 to the dresser bracket 14 and then positioning the dowel pin 25 in its clearance hole 30 by means of the opposing adjustment screws 24. This causes the bearing housing 17 to rotate about the bearing housing pivot 23. When the alignment requirements have been satisfied in both the vertical and horizontal planes, FIGS. 2 and 4, respectively, the adjustment is held by securing the locking screws 26.

What is claimed is:

1. An adjustable double disc grinder dresser comprising:

a dresser arm mounted on a shaft, a bracket including spaced opposing walls, one of said walls including means for supporting one end of said shaft for pivotal displacement about its axis and for limited pivotal displacement about mutually perpendicular vertical and horizontal axes, said one supporting means including a face to face mounted pair of ball bearings, and spacer means having a width selected to locate the bearing load centers of said ball bearings coincident on the axis of rotation of said shaft, said mutually vertical and horizontal axes intersecting at said point of coincidence, and means for infinitely varying the horizontal location of the axis of said shaft through a limited range, and means for supporting the other end of said shaft for pivotal displacement about its axis and for limited pivotal displacement about mutually perpendicular vertical and horizontal axes, said other supporting means including a face to face mounted pair of ball bearings, and spacer means having a width selected to locate the bearing load centers of said ball bearings coincident on the axis of rotation of said shaft, said mutually vertical and horizontal axes intersecting at said point of coincidence, and means for infinitely varying the vertical location of the axis of said shaft through a limited range, whereby the ends of the shaft can be shifted relatively horizontally and vertically to align the shaft axis.

2. An adjustable double disc grinder dresser according to claim 1, wherein said means for supporting said one end of said shaft includes a housing and means for pivotally securing said housing to said one wall at a location vertically above the axis of said shaft, and wherein said means for supporting the other end of said shaft includes a housing and means for pivotally securing said housing to said other wall at a location horizontally across said shaft axis.

* * * * *